US008960152B1

(12) United States Patent
Miller

(10) Patent No.: US 8,960,152 B1
(45) Date of Patent: Feb. 24, 2015

(54) MANUALLY ACTUATED AUTOMOTIVE ENGINE THROTTLE OVERRIDE

(76) Inventor: Ralph Allen Miller, Monmouth Beach, NJ (US)

( * ) Notice: Subject to any disclaimer, the term of this patent is extended or adjusted under 35 U.S.C. 154(b) by 892 days.

(21) Appl. No.: 13/065,208

(22) Filed: Mar. 17, 2011

(51) Int. Cl.
*F02D 11/10* (2006.01)

(52) U.S. Cl.
USPC ..... 123/399

(58) Field of Classification Search
USPC ..... 123/399, 361, 337, 350, 352, 376, 396, 123/400
See application file for complete search history.

(56) References Cited

U.S. PATENT DOCUMENTS

| | | | | |
|---|---|---|---|---|
| 4,181,103 | A * | 1/1980 | Sturdy | 123/361 |
| 5,095,769 | A * | 3/1992 | Bowden | 74/480 R |
| 5,177,682 | A * | 1/1993 | Oo et al. | 123/352 |
| 7,152,580 | B2 * | 12/2006 | Wetor et al. | 123/396 |
| 7,487,839 | B2 * | 2/2009 | Boscher et al. | 166/379 |

* cited by examiner

*Primary Examiner* — Hieu T Vo

(57) ABSTRACT

One embodiment of an independent engine throttle override comprised of an override switch in conjunction with of an override module which houses a fixed resistor and switching relay to provide the capability to return a runaway automotive engine to idle speed without impacting operability of other vehicle control systems.

3 Claims, 1 Drawing Sheet

Manually Actuated Engine Throttle Override

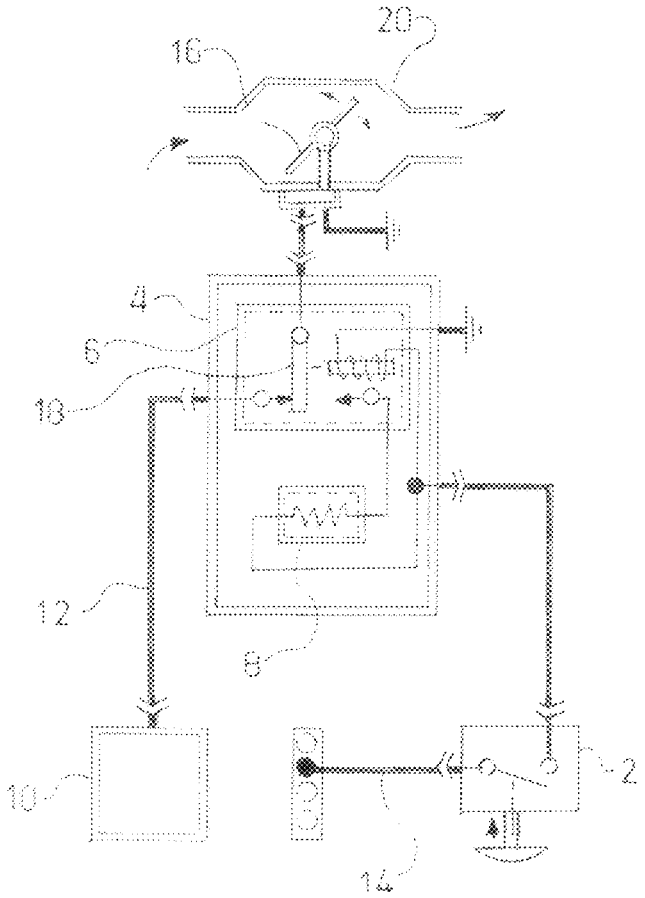
Manually Actuated Engine Throttle Override

MANUALLY ACTUATED AUTOMOTIVE ENGINE THROTTLE OVERRIDE

CROSS-REFERENCE TO RELATED APPLICATIONS

Provisional Patent No. 61/339,754

FEDERALLY SPONSORED RESEARCH

Not Applicable

SEQUENCE LISTING OR PROGRAM

Not Applicable

BACKGROUND

1. Field of Invention

This invention relates to automotive engine speed control means, specifically backup manually activated throttle closure mechanisms.

2. Prior Art

The majority of state-of-the-art automotive engines employ an electronic module (ECM) to control engine operation. Electronic control of the power train provides optimum vehicle drivability, fuel economy and minimization of harmful exhaust emissions. These engines no longer have any mechanical connection between the accelerator pedal and the throttle valve. Power control is exclusively drive-by-wire, analogous to that of many current aircraft control systems. However, unlike commercial and military aircraft, automotive systems do not employ redundant means to reduce engine power should a malfunction such as engine speed runaway, occur due to several causes, such as:

- Physical interference with the accelerator pedal itself by foreign objects such as floor pads, or impeded operation due to binding, wear and tear.
- Intermittent quirks in software circuitry, such as stray electromagnetic interference, shorting by microscopic "whiskers" at solder joints on circuit boards, or control sensor anomalies.
- Inadvertent overlapping of the accelerator pedal by the operator's foot when applying the brakes.
- Simultaneous application of the brake and accelerator. Driver's use of the left foot for brake and right foot for the accelerator contributes to confusion or panic in an emergency.

Since the problem has multiple possible causes of transient, intermittent nature, identification and elimination is difficult. This runaway phenomenon can be overcome by shutting off the ignition, or shifting the transmission into neutral. Employing the former shuts down the engine with consequent loss of braking and steering power boosts to the detriment of vehicle control. Shifting into neutral will curtail the runaway vehicle acceleration, but the engine RPM will increase due to the engine being unloaded further adding to the confusion and panic consequent to the situation. Neither of the foregoing remedies provide a satisfactory recourse for shortstopping this potentially catastrophic situation.

In comparison my invention offers an uncomplicated redundant manually actuated electromechanical means to override the Engine Control Module (ECM) and return the engine to idle speed without compromising other aspects of vehicle control. This override system is entirely independent of the vehicle primary propulsion and braking systems. It's high reliability is inherent due to its simplicity and straightforward interconnection with multiple electronic solid state control circuitry of the vehicle.

SUMMARY

This invention is directed to a manually actuated engine throttle valve override which provides an emergency means for returning the throttle valve to its idle position should the primary throttle control be disabled with consequent uncontrolled engine speed runaway.

DRAWINGS

FIG. 1 illustrates the invention schematically

DRAWINGS

Reference Numerals

2 Override Switch
4 Override Module
6 Relay
8 Resistor
10 Engine Control Module (ECM) (Reference)
12 ECM Output Signal
14 Vehicle Power Buss Voltage (Ref)
16 Throttle Body Valve (Ref)
18 Relay Armature
20 Throttle Body (Ref)

DETAILED DESCRIPTION OF EMBODIMENTS

FIG. 1, schematically illustrates one embodiment of my invention employs a dash mounted manually actuated override switch 2, override module (OM) 4 which houses a relay 6 and a fixed value resistor 8.

The ECM 10 output signal 12 is wired to the normally closed input side of the relay 6 thus allowing control of the throttle body valve 16 position by the ECM 10 during normal vehicle operation. If the engine uncontrollably overspeeds, actuation of the override switch 2 causes regulated vehicle buss voltage 14 to energize the relay armature 18 causing control of the throttle body valve to be switched from the ECM 10 to the low voltage output side of the OM resister 8 which is energized simultaneously with the relay 6. The resistor 8 output voltage signal corresponds to that required to return the throttle body valve 16 to its idle position.

ADDITIONAL EMBODIMENTS

Other possible variants of the foregoing include a configuration based on the override function being actuated by a switch incorporated into the parking brake pedal assembly. Many existing vehicle parking brake assemblies already include a switch to actuate an indicator on the vehicle dash display as an engagement reminder. This switch could readily be adapted to connect with the override module. Yet another possibility would be a variant that employs dual actuation means; from either the hand operated switch, or the parking brake switch.

ADVANTAGES

From the description above a number of advantages of some embodiments of my Manually Actuated Automotive Engine Throttle Override become evident:

(a) It provides a parallel independent means for regaining control over a runaway automotive engine regardless of the cause for the condition.

(b) It performs this function without impacting braking or steering system functionality.

(c) Control of the vehicle is immediate and drive off capability is provided albeit at a reduced power level.

(d) It is readily retrofitable into in service vehicles with necessitating any modifications to other operating or control systems.

(e) If further avails itself for incorporation into vehicle theft prevention systems to enhance their capability in that regard.

CONCLUSION, RAMIFICATIONS, AND SCOPE

Accordingly, the reader will see that the Manually Actuated Automotive Engine Throttle Override provides a solution for interrupting ECM inputs to the throttle body position control mechanism without impacting operation of other vehicle control systems. Thus reestablishing driver capability for bringing the vehicle to a safe controlled stop.

Although the description above contains many specifities, those should not be construed as limiting the scope of the embodiment but as merely providing illustrations of some of the presently preferred embodiments.

Thus the scope of the embodiment should be determined by the appended claims and their legal equivalents, rather than by examples given.

I claim:

1. A manually automotive engine throttle override subsystem comprising:

a. hand actuated override switch b. override module housing a relay and a resistor c. plurality of electrical connections for interfacing with certain engine control components whereby when said override switch is closed the input voltage signal to the throttle body valve is switched from the engine control module output to said override module resistor output whose voltage level is such as to cause the throttle body valve to be positioned at engine idle setting.

2. The override subsystem of claim 1 except having said hand actuated switch replaced by foot switch.

3. The override subsystem of claim 1 except having said hand actuated switch connected in parallel with foot actuated switch.

* * * * *